US010900716B2

(12) United States Patent
Ariyama et al.

(10) Patent No.: US 10,900,716 B2
(45) **Date of Patent: *Jan. 26, 2021**

(54) HEAT EXCHANGER

(71) Applicant: MAHLE FILTER SYSTEMS JAPAN CORPORATION, Tokyo (JP)

(72) Inventors: Masahiro Ariyama, Yokohama (JP); Kenji Wada, Kawagoe (JP); Shozo Wakamatsu, Fujimino (JP); Tadashi Nishikoba, Fujimino (JP); Kakuei Kunii, Iruma (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 100 days.

This patent is subject to a terminal disclaimer.

(21) Appl. No.: 16/162,664

(22) Filed: Oct. 17, 2018

(65) Prior Publication Data

US 2019/0049188 A1 Feb. 14, 2019

Related U.S. Application Data

(62) Division of application No. 15/341,473, filed on Nov. 2, 2016, now Pat. No. 10,228,192.

(30) Foreign Application Priority Data

Dec. 28, 2015 (JP) ..... 2015-255636

(51) Int. Cl.
*F28D 9/00* (2006.01)
*F28F 3/04* (2006.01)
(Continued)

(52) U.S. Cl.
CPC ..... *F28D 9/005* (2013.01); *F28D 9/0056* (2013.01); *F28F 3/044* (2013.01); *F28F 9/0075* (2013.01);
(Continued)

(58) Field of Classification Search
CPC ..... F28D 9/005; F28D 9/0034; F28D 9/044; F28D 2021/0089; F28F 3/044; F28F 9/0075
See application file for complete search history.

(56) References Cited

U.S. PATENT DOCUMENTS 4,708,199 A 11/1987 Yogo et al.
5,760,333 A 6/1998 Kitahara et al.
(Continued)

FOREIGN PATENT DOCUMENTS

CA 2839884 A1 8/2014
DE 19654365 A1 6/1998
(Continued)

OTHER PUBLICATIONS

USPTO Notice of Allowance, U.S. Appl. No. 15/223,466, dated Nov. 6, 2018, 10 pages.
(Continued)

*Primary Examiner* — Eric S Ruppert
(74) *Attorney, Agent, or Firm* — Foley & Lardner LLP

(57) ABSTRACT

What is disclosed is a heat exchanger including: a core including a plurality of core plates, first and second passages, and a vertical passage; a base plate including a passage port; and a distance plate; wherein the first vertical passage and the passage port are arranged apart from each other in a direction orthogonal to a stacking direction of the core plates, and wherein the distance plate includes a bottom wall part and a swelling part, the bottom wall part being a thin plate-shaped and being joined to an upper surface of the base plate, the swelling part swelling up in the stacking direction from the bottom wall part so as to surround a circumference of a communication passage which communicates the first vertical passage with the passage port and
(Continued)

being joined to a lowermost surface of the core in a flange part of a tip of the swelling part.

5 Claims, 12 Drawing Sheets

(51) Int. Cl.
*F28F 9/007* (2006.01)
*F28D 21/00* (2006.01)

(52) U.S. Cl.
CPC .. *F28D 2021/0089* (2013.01); *F28F 2210/08* (2013.01)

(56) References Cited

U.S. PATENT DOCUMENTS

| | | | |
|---|---|---|---|
| 5,964,280 | A | 10/1999 | Wehrmann et al. |
| 5,964,283 | A | 10/1999 | Pavlin |
| 7,762,090 | B2 | 7/2010 | Lee |
| 9,759,498 | B2 | 9/2017 | Kim et al. |
| 2002/0066552 | A1 | 6/2002 | Komoda |
| 2007/0261832 | A1 | 11/2007 | Ware |
| 2010/0206516 | A1 | 8/2010 | Muller-Lufft et al. |
| 2012/0061060 | A1 | 3/2012 | Stoll et al. |
| 2012/0205085 | A1 | 8/2012 | Ariyama |
| 2012/0216562 | A1 | 8/2012 | Kadle et al. |
| 2012/0325446 | A1 | 12/2012 | Wakamatsu et al. |
| 2013/0081794 | A1 | 4/2013 | Tuchowski et al. |
| 2014/0069137 | A1 | 3/2014 | Wu |
| 2014/0224455 | A1 | 8/2014 | Kalbacher et al. |
| 2015/0101781 | A1 | 4/2015 | Kim |
| 2016/0018169 | A1 | 1/2016 | Powell et al. |
| 2016/0161192 | A1 | 6/2016 | Kim et al. |
| 2016/0209119 | A1 | 7/2016 | Martin et al. |
| 2016/0282053 | A1 | 9/2016 | Bardeleben et al. |
| 2017/0030661 | A1 | 2/2017 | Ariyama et al. |
| 2018/0080693 | A1 | 3/2018 | Wang et al. |

FOREIGN PATENT DOCUMENTS

| | | | |
|---|---|---|---|
| DE | 10 2009 022 919 | A1 | 12/2010 |
| DE | 10 2009 034 752 | A1 | 2/2011 |
| EP | 0 623 798 | A2 | 11/1994 |
| EP | 1 522 812 | A2 | 4/2005 |
| JP | 2013-007516 | A | 1/1900 |
| JP | 64-022177 | U | 2/1989 |
| JP | 2002-332818 | A | 11/2002 |
| JP | 2011-007410 | A | 1/2006 |
| JP | 2011-007411 | A | 1/2011 |
| JP | 2012-127045 | A | 7/2012 |
| JP | 5161709 | B2 | 3/2013 |
| JP | 2006-017430 | A | 1/2016 |
| WO | WO-2014/027514 | A1 | 2/2014 |
| WO | WO-2014/073471 | A1 | 5/2014 |
| WO | WO-2015/025908 | A1 | 2/2015 |

OTHER PUBLICATIONS

Extended European Search Report, dated Jan. 19, 2017, 6 pages.
Extended European Search Report, dated May 19, 2017, 7 pages.
USPTO Advisory Action, 158223,466, dated Aug. 24, 2018, 8 pages.
WO 2014/027514 A1 English Machine Translation—Retrieved Sep. 2017.

HEAT EXCHANGER

CROSS REFERENCE TO RELATED APPLICATIONS

This application is a divisional of U.S. application Ser. No. 15/341,473, filed on Nov. 2, 2016, which claims benefit of priority from the prior Japanese Application No. 2015-255636, filed on Dec. 28, 2015 the entire contents of all of which are incorporated herein by reference.

BACKGROUND OF THE INVENTION

This invention relates to improvement of a heat exchanger which is used for an oil cooler for a vehicle or the like.

Patent Document 1 (Japanese Patent No. 5161709) discloses an oil cooler for a vehicle as a heat exchanger. The oil cooler includes a core, a base plate, and a distance plate. The core includes a plurality of core plates, oil passages (the first medium passage), cooling water passages (the second medium passage), and a vertical passage. The core plates are stacked. The oil passages in which oil (the first medium) flows and the cooling water passages in which cooling water (the second medium) flows are alternately formed in a stacking direction between adjacent core plates. The vertical passage in which oil or cooling water flows is formed along the stacking direction of the core plate. The base plate includes a passage port connected to the vertical passage and is thicker than the core plate. The distance plate is interposed between the base plate and the core, and thicker than the core plate. Furthermore, the distance plate includes a communication passage (bypass passage) which communicates the vertical passage with the passage port. The communication passage is formed through the distance plate.

SUMMARY OF THE INVENTION

In case that the vertical passage which is formed in the core and the passage port which is formed in the base plate aren't arranged coaxially but apart from each other in a direction orthogonal to the stacking direction (that is, a direction along a surface of the distance plate), the communication passage is formed as a slit hole which is slender in the direction along the surface of the distance plate.

In order to suppress pressure loss of the communication passage, it is necessary to largely secure a cross-sectional area of the communication passage. However, to widen an opening area of the communication passage causes deterioration of rigidity of the distance plate. Thereby, there is a risk of causing deterioration of rigidity of the heat exchanger. Furthermore, in case that thickness of the distance plate is thickened in order to widen the cross-sectional area of the communication passage, the heat exchanger itself gets high in height. Thereby, there is a risk of causing not only deterioration of layout performance but also increase in the total weight of the heat exchanger.

In view of the foregoing, it is an object of the present invention to provide a heat exchanger which is free of the above-mentioned drawback. According to the present invention, a distance plate, which is joined to a base plate, is made to have a swelling part in its bottom wall part while achieving weight reduction by thinning the distance plate. Thereby, it is possible to arrange a communication passage, which communicates a vertical passage with a passage port or communicates vertical passages each other, inside the swelling part.

According to one aspect of the present invention, a heat exchanger comprises:

- a core including:
  - a plurality of core plates which is stacked;
  - first passages in which a first medium flows;
  - second passages in which a second medium flows, the first passages and the second passages being alternately formed between adjacent core plates in a stacking direction; and
  - a first vertical passage in which the first medium or the second medium flows, the first vertical passage being formed along the stacking direction;
- a base plate including a passage port formed therethrough; and
- a distance plate interposed between the base plate and the core;
- wherein the first vertical passage and the passage port are arranged apart from each other in a direction orthogonal to the stacking direction and communicated with each other by a communication passage, and
- wherein the distance plate includes a bottom wall part and a swelling part, the bottom wall part being a thin plate-shaped and being joined to an upper surface of the base plate, the swelling part swelling up in the stacking direction from the bottom wall part so as to surround a circumference of the communication passage which communicates the first vertical passage with the passage port and being joined to a lowermost surface of the core in a flange part of a tip of the swelling part.

According to another aspect of the present invention, a heat exchanger comprises:

- a core including:
  - a plurality of core plates which is stacked;
  - first passages in which a first medium flows;
  - second passages in which a second medium flows, the first passages and the second passages being alternately formed between adjacent core plates in a stacking direction; and
  - a plurality of first vertical passages in which the first medium or the second medium flows, the first vertical passages being formed along the stacking direction;
- a base plate; and
- a distance plate interposed between the base plate and the core;
- wherein each of the first vertical passages is arranged apart from each other in a direction orthogonal to the stacking direction and communicated with each other by a communication passage, and
- wherein the distance plate includes a bottom wall part and a swelling part, the bottom wall part being a thin plate-shaped and being joined to an upper surface of the base plate, the swelling part swelling up in the stacking direction from the bottom wall part so as to surround a circumference of the communication passage which communicates each of the first vertical passages with each other and being joined to a lowermost surface of the core in a flange part of a tip of the swelling part.

DETAILED DESCRIPTION OF THE INVENTION

Figure 1:
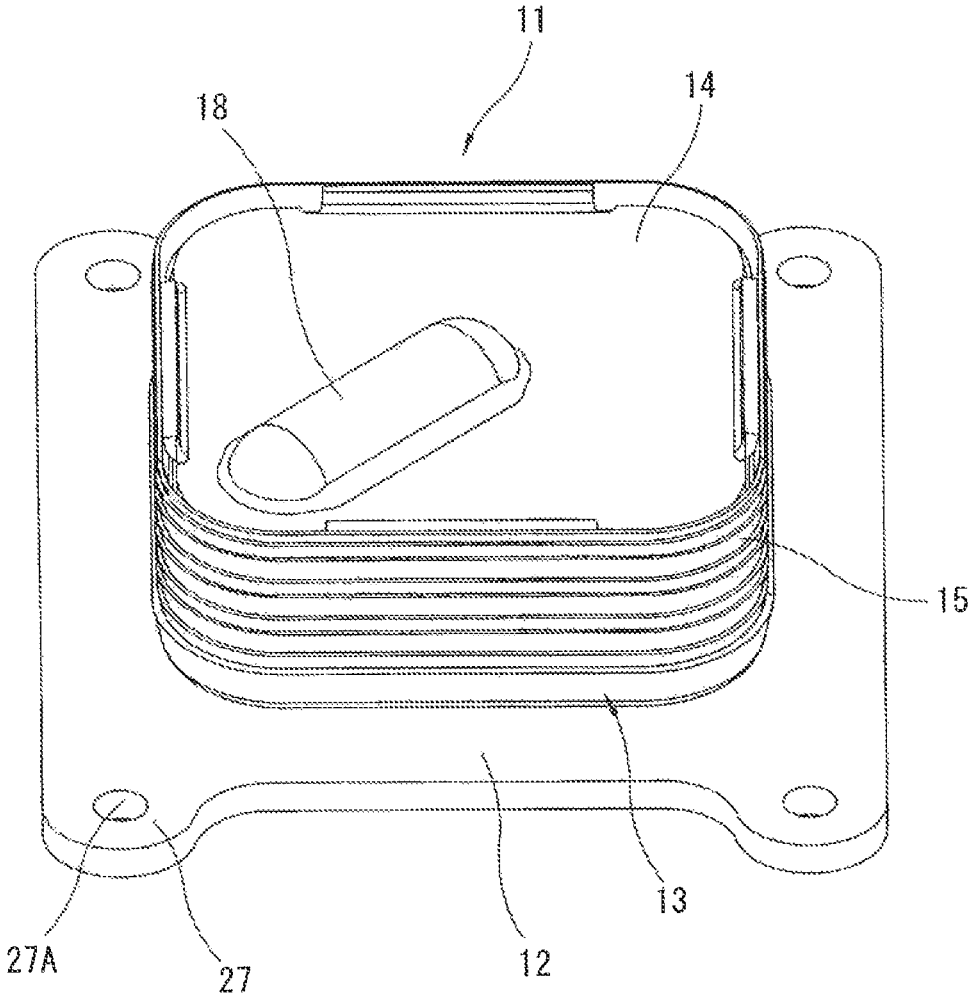
FIG. 1 is a perspective view of an oil cooler in the first embodiment of a heat exchanger according to the present embodiment.
Figure 2:
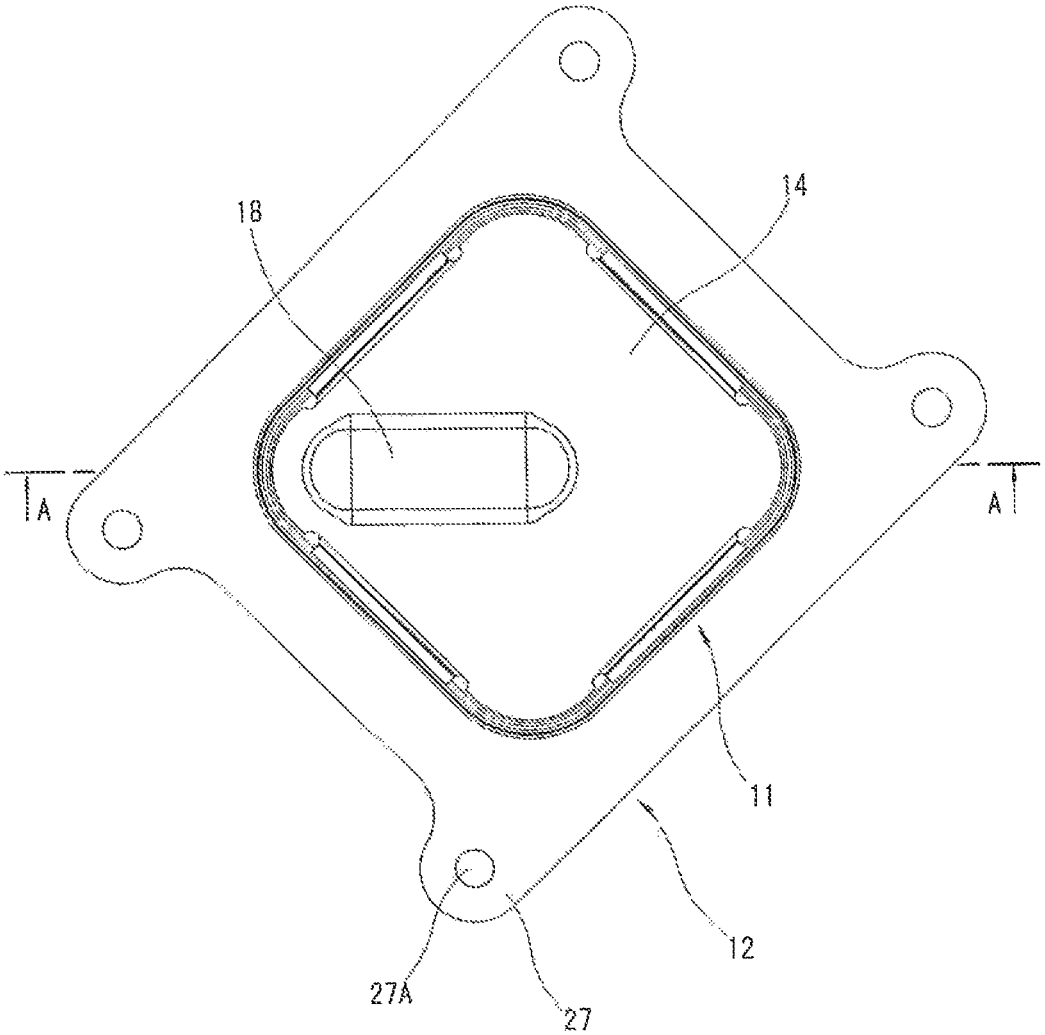
FIG. 2 is a top view of the oil cooler of the first embodiment.

FIG. 1 to FIG. 5 show an oil cooler which cools down oil used as lubricating oil of an internal combustion engine of a vehicle or hydraulic oil of an automatic transmission through a heat exchange with cooling water as an embodiment of a heat exchanger according to this invention. Hereinafter, in order to make explanations clearer, terms respectively meaning "upper" and "lower" are used on the basis of the posture in FIG. 3 as necessary. More specifically, a direction from a base plate 12 toward a core 11 along a stacking direction (described later) is defined as an "upper" direction in the description. However, in actual use of the oil cooler, it isn't limited to the attached posture of FIG. 3.

An oil cooler includes a core 11 formed by stacking a plurality of core plates 15 which is thin plate-shaped with fin plates 16; a base plate 12 which is relatively thick plate-shaped; and a distance plate 13 interposed between the core 11 and the base plate 12. Furthermore, a top plate 14 which is thicker than the core plate 15 is stacked on the top of the core 11. All of these components of the oil cooler are made of aluminum-based materials, and the respective components are integrally brazed by heating in a furnace while held by a jig after assembled in a prescribed state. As a way for supplying a brazing material, the core plate 15 or the like may be formed as a clad material, which is a material where a surface of base material made of aluminum-based material is coated with a brazing material (for example, an aluminum-based material having a inciting point lower than that of the base material). Furthermore, some other brazing material which is sheet-shaped or the like may be arranged in the bonding surface.

Figure 3:
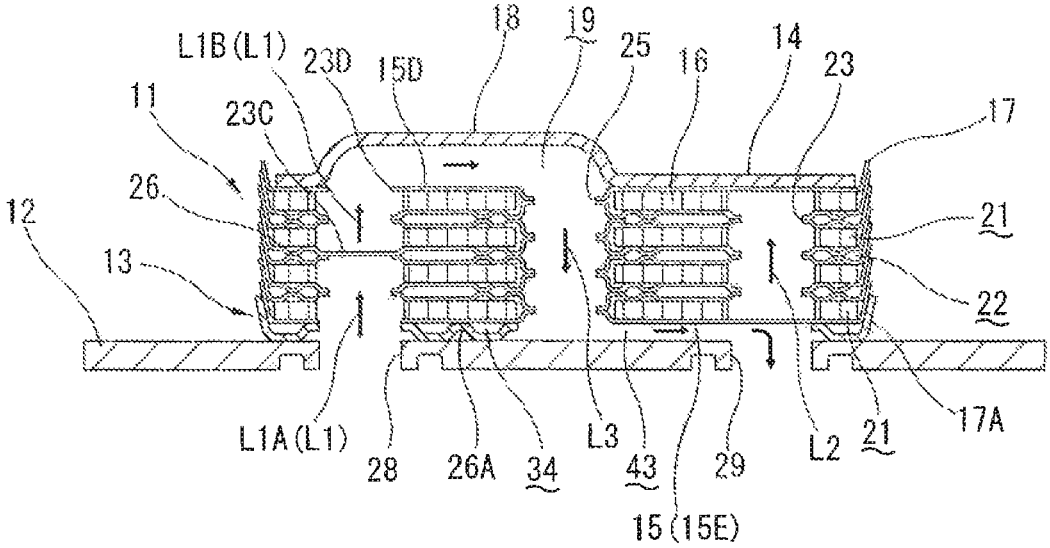
FIG. 3 is a cross-sectional view taken along a plane indicated by the line A-A in FIG. 2.
Figure 4:
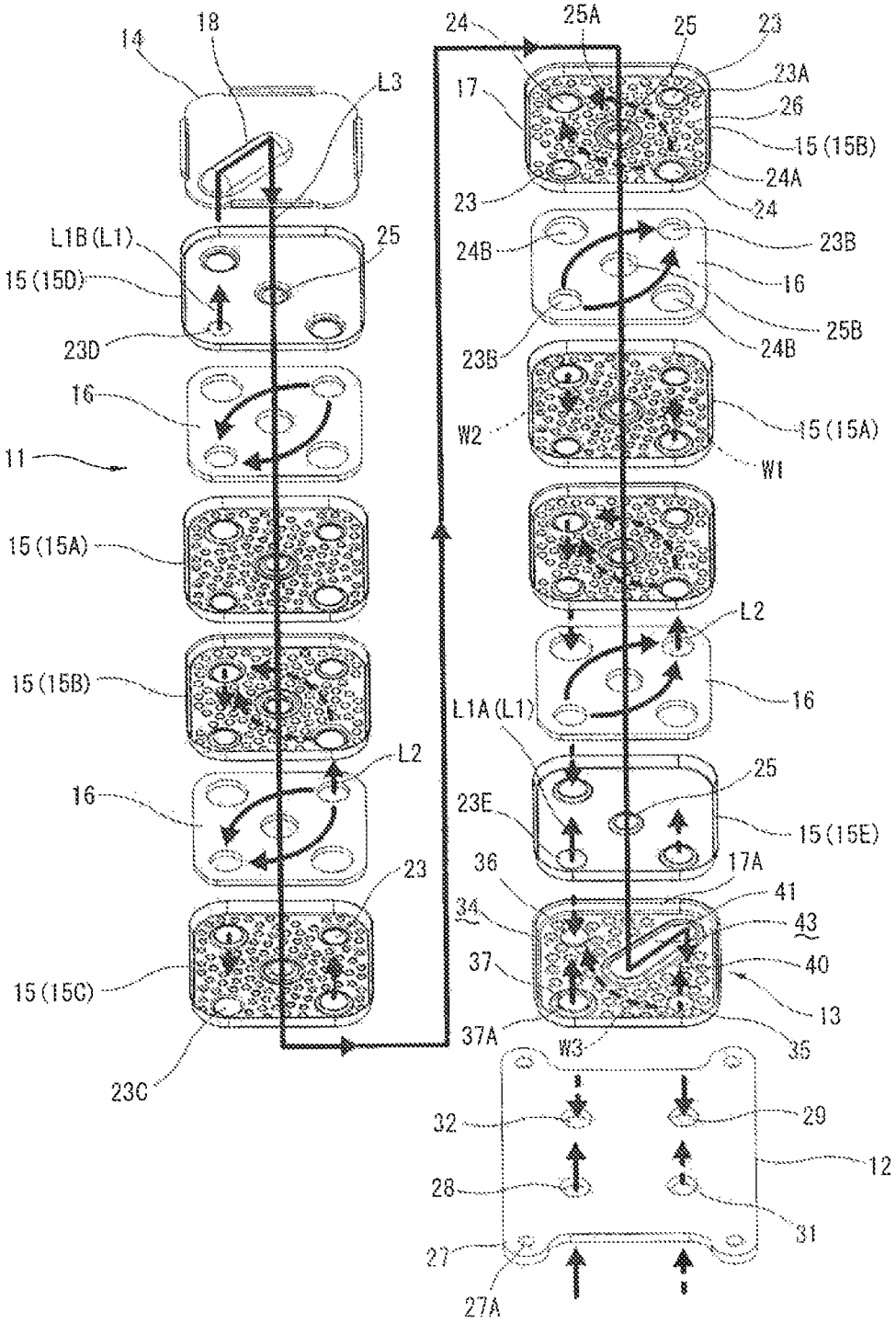
FIG. 4 is an exploded perspective view of the oil cooler of the first embodiment.

As shown in FIG. 4, the core 11 includes oil passages 21 (see FIG. 3) as first medium passages in which oil as first medium flows and cooling water passages 22 (see FIG. 3) as second medium passages in which cooling water as second medium flows. Each of the core plates 15 is respectively formed into an identical rectangular shape as a basic shape, that is, the core plates 15 are shallow plate-shaped. The core plates 15 are stacked up with the fin plates 16, and thereby the oil passages 21 and the cooling water passages 22 are alternately formed in a stacking direction between two adjacent core plates 15. In fact, multiple types of the core plates 15 which have slightly different details exist, and they are combined suitably. They can be classified into a lower-side core plate 15A located on a lower side of each oil passage 21 and an upper-side core plate 15B located on an upper side of each oil passage 21. They are stacked in order in a state of putting the fin plate 16 between the two (that is, in the oil passages 21). Each of the core plates 15, which is rectangular, includes a circumferential flange part 17 which stands up so as to be a tapered shape around the core plate 15. The oil passages 21 and the cooling water passages 22 are alternately formed by brazing in a state that these circumferential flange parts 17 are stacked. That is, in the core 11, a housing which surrounds circumferences of the oil passages 21 and the cooling water passages 22 is formed by stacking the circumferential flange parts 17 of each of core plates 15 and by joining them. In a word, the core 11 has a housing-less structure.

In each of the core plates 15, oil communication holes 23 which are circular shaped are formed at two corners on one diagonal line, and cooling water communication holes 24 which are circular shaped are formed at two corners on the other diagonal line. Furthermore, an oil outlet hole 25 which is circular shaped is formed in the center position of the core plate 15. In each of the core plates 15 constituting the core 11, these oil communication holes 23, cooling water communication holes 24, and oil outlet hole 25 are arranged so as to line up respectively in a stacking direction when each of the core plates 15 is stacked. Furthermore, circular boss parts 23 A, 24A, and 25A, which are arranged around each of the holes 23, 24, and 25, are respectively joined to those of each adjacent core plate 15. Thereby, the oil passages 21 and the cooling water passages 22 in each stage are respectively sealed up, and vertical passages L1, L2, L3, W1, and W2, which line up in the stacking direction, are formed. Furthermore, the boss parts 23A, 24A, and 25A of the lower-side core plate 15A have different swelling directions from those of the upper-side core plate 15B.

Furthermore, each of the core plates 15 have a plurality of dimples 26. Each of the dimples 26 has a hemispherical shape or a truncated cone shape and juts out into the cooling water passage 22. As shown in FIG. 3, each of the dimples 26 is located in the cooling water passage 22. Furthermore, the top of the dimple 26 of the lower-side core plate 15A and the top of the dimple 26 of the upper-side core plate 15B touch each other, and they are joined by brazing.

Furthermore, not shown in details, the fin plate 16 has an ordinary structure having fine fins, and includes opening parts 23B, 24B, and 25B, which are circular, in places corresponding to the oil communication holes 23, the cooling water communication holes 24, and the oil outlet hole 25 of the core plate 15.

Furthermore, the first embodiment is constituted as an oil cooler of a multipath type. In an intermediate-stage-lower-side core plate 15C, which is a core plate 15 constituting an oil passage 21 corresponding to the intermediate stage in oil passages 21 stacked in a plurality of stages, one oil communication hole 23 is sealed as a sealing part 23C. Although the core plate 15C is the lower-side core plate 15A of the intermediate stage in FIG. 4, it may be the upper-side core plate 15B of the intermediate stage. That is, either the lower-side core plate 15A or the upper-side core plate 15B of the intermediate stage becomes the intermediate-stage-lower-side core plate 15C.

An uppermost-upper-side core plate 15D located on an upper side of an oil passage 21 of the topmost stage doesn't touch any core plates 15 but the top plate 14, so it has no dimples 26. In the uppermost-upper-side core plate 15D, only one oil communication hole 23D is formed as a simple hole not having the boss part 23A. Furthermore, a lowermost-lower-side core plate 15E located on a lower side of an oil passage 21 of the bottom stage doesn't touch any core plates 15 but the distance plate 13, so it has no dimples 26. In the lowermost-lower-side core plate 15E, only one oil communication hole 23E is formed as a simple hole not having the boss part 23A.

The top plate 14 which is stacked on the top of the core 11 including a plurality of the core plates 15 is brazed on an upper surface of the uppermost-upper-side core plate 15D. Furthermore, the top plate 14 has a top swelling part 18 extending along a diagonal line. A top communication passage 19 is formed between the top swelling part 18 and the uppermost-upper-side core plate 15D (see FIG. 3). The top communication passage 19 communicates the oil communication hole 23D which is formed at a corner part with the oil outlet hole 25 which is formed in the center position.

The base plate 12 includes attaching portions 27, an oil-inlet passage port 28, an oil-outlet passage port 29, a cooling-water-inlet passage port 31, and a cooling-water-outlet passage port 32. The attaching portions 27, which have attaching holes 27A, are arranged in four corners of the base plate 12. The oil-inlet passage port 28 is formed at a place corresponding to one oil communication port 23 of the core plate 15, and the oil-outlet passage port 29 is formed at a place corresponding to the other oil communication port 23 of the core plate 15. Furthermore, the cooling-water-inlet passage port 31 is formed at a place corresponding to one cooling water communication port 24 of the core plate 15, and the cooling-water-outlet passage port 32 is formed at a place corresponding to the other cooling water communication port 24 of the core plate 15. The oil cooler is installed on a control valve housing or the like in an internal combustion engine/automatic transmission side through the attaching portions 27. The oil-inlet passage port 28 and the oil-outlet passage port 29 are respectively connected to an oil passage in the internal combustion engine/automatic transmission side. The cooling-water-inlet passage port 31 and the cooling-water-outlet passage port 32 are respectively connected to a cooling water passages in the internal combustion engine/automatic transmission side.

Figure 5:
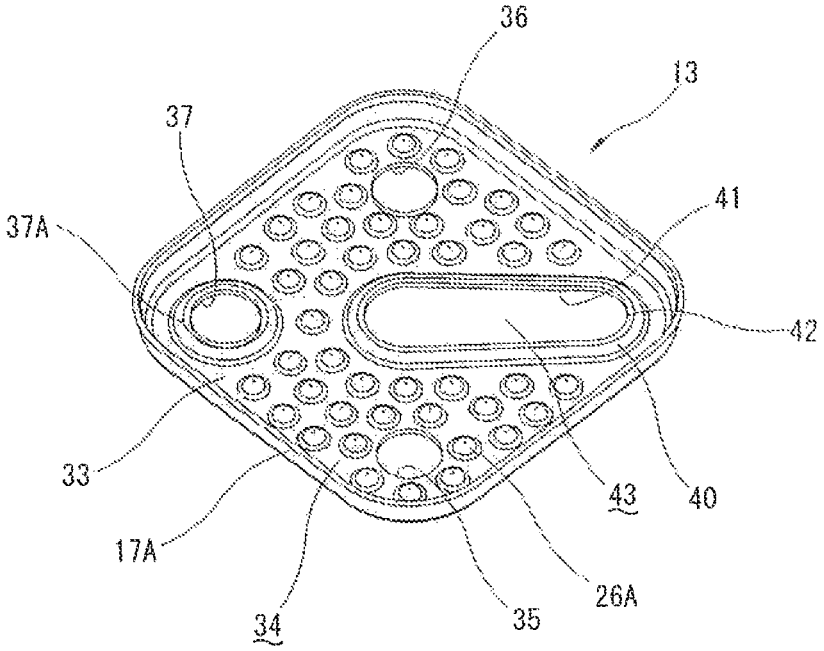
FIG. 5 is a perspective view of a distance plate of the first embodiment.

Next, the distance plate 13 is explained on the basis of FIG. 5, which is a perspective view showing the distance plate 13. The plate thickness of the distance plate 13 is thicker than that of the core plate 15, but much thinner than that of the base plate 12. The distance plate 13 is rectangular and shallow plate-shaped just like the core plate 15. The distance plate 13 includes a bottom wall part 33 which is thin-plate shaped. The bottom wall part 33 is adhered and joined to an upper surface of the base plate 12 by brazing. The bottom wall part 33 includes a circumferential flange part 17A in its circumference. The circumferential flange part 17A stands up so as to be a tapered shape just like the circumferential flange part 17 of the core plate 15. The circumferential flange part 17A is joined by brazing after put on the circumferential flange part 17 of the lowermost-lower-side core plate 15E.

Furthermore, the bottom wall part 33 has a plurality of dimples 26A which has a hemispherical shape or a truncated cone shape and which juts out into the stacking direction. A tip of the dimple 26A is touched with a lower surface side of the lowermost-lower-side core plate 15E and joined there by brazing.

As shown in FIG. 3, an auxiliary passage 34 in which oil or cooling water flows is liquid-tightly formed between the upper surface of the bottom wall part 33 and the lower surface of the lowermost-lower-side core plate 15E. In this first embodiment, it is constituted so that cooling water flows in the auxiliary passage. Specifically, the bottom wall part 33 includes a cooling-water-inlet communication port 35 and a cooling-water-outlet communication port 36 in places respectively corresponding to the cooling-water-inlet passage port 31 and the cooling-water-outlet passage port 32 of the base plate 12. These cooling-water-inlet communication port 35 and the cooling-water-outlet communication port 36 are formed as simple holes having no boss parts. Therefore, as shown by dashed arrow W3 in FIG. 4, part of cooling water introduced from the cooling-water-inlet passage port 31 through the cooling-water-inlet communication port 35 flows in the auxiliary passage 34, and that is drained off from the cooling-water-outlet passage port 32 through the cooling-water-outlet communication port 36.

Furthermore, the bottom wall part 33 includes an oil-inlet communication hole 37 in a place corresponding to the oil-inlet passage port 28 of the base plate 12. A boss part 37A which is circular and juts out into the stacking direction is formed around the oil-inlet communication hole 37. A tip of the boss part 37A is joined to a lower surface of a circumference of the oil communication hole 23E of the lowermost-lower-side core plate 15E, and thereby the auxiliary passage 34 in which cooling water flows and the oil communication hole 23E (that is, a lower-side-oil-vertical passage L1A, detailed later) are liquid-tightly partitioned each other.

The oil outlet hole 25 which is located at the center position of the lowermost-lower-side core plate 15E and the oil-outlet passage port 29 which is located at a corner part of the base plate 12 are arranged apart from each other in a direction orthogonal to the stacking direction. Furthermore, a swelling part 40 is formed throughout a slender elliptic range along the diagonal line so as to communicate the oil outlet hole 25 with the oil-outlet passage port 29. The swelling part 40 swells up in the stacking direction from the bottom wall part 33. A flange part 42 of a tip of the swelling part 40 is bent inside into a flange shape throughout its whole circumference, and an opening part 41 which largely and elliptically opens is formed inside the flange part 42. In other words, in the tip of the swelling part 40, the flange part 42 which is nearly parallel to the bottom wall part 33 exists throughout the whole circumference of the opening part 41, and an upper surface of the flange part 42 is adhered and joined to the lower surface of the lowermost-lower-side core plate 15E by brazing. In more detail, in one side of the swelling part 40, which is near to the center in the distance plate 13, the flange part 42 of the tip of the swelling part 40 is joined to the lower surface of the circumference of the oil outlet hole 25 in the lowermost-lower-side core plate 15E. Furthermore, in the other side of the swelling part 40, which is near to the corner part in the distance plate 13, the bottom wall 33 around the swelling part 40 is joined to the upper surface of the circumference of the oil-outlet passage port 29 in the base plate 12.

A space inside the swelling part 40, that is, the space surrounded by the internal surface of the swelling part 40, the upper surface of the base plate 12, and the lower surface of the lowermost-lower-side core plate 15E is used as a communication passage 43. The communication passage 43 communicates the oil outlet hole 25 (that is, the oil-outlet vertical passage L3) with the oil-outlet passage port 29, and thereby they are linked each other.

As shown in FIG. 3 and FIG. 4, several vertical passages L1, L2, L3, W1, and W2, which extend in the stacking direction, are constituted in a state that each component described above is stacked and integrally brazed. Through these vertical passages L1, L2, L3, W1, and W2, oil is led from the oil-inlet passage port 28 to the oil-outlet passage port 29 through the oil passages 21 of each stage, and cooling water is led from the cooling water-inlet passage port 31 to the cooling water-outlet passage port 32 through the cooling water passages 22 of each stage. In FIG. 4, currents of oil are shown by solid arrows, and currents of cooling water are shown by dashed arrows.

Specifically, the oil vertical passage L1 constituted by stacking one oil communication hole 23 of each core plate 15, which is lined up in the upper side of the oil-inlet passage port 28; the oil vertical passage L2 constituted by stacking the other oil communication hole 23 of each core plate 15; and the oil vertical passage L3 constituted by stacking the oil outlet hole 25 located in the center of each core plate 15; are constituted as oil vertical passages extending in the stacking direction in the core 11. Furthermore, the oil vertical passage L1 is partitioned off into a lower-side-oil-vertical passage L1A and an upper-side-oil-vertical passage L1B by the sealing part 23C lying midway.

In the lower-side-oil-vertical passage L1A, its lower end opens toward the oil-inlet passage port 28 and is linearly connected to the oil-inlet passage port 28. In the upper-side-oil-vertical passage L1B, its upper end opens toward the top communication passage 19 formed by the top plate 14. These oil vertical passages L1A and L1B are respectively communicated with each oil passage 21 between the core plates 15A and 15B.

In the oil vertical passage L2 which is constituted by the other oil communication hole 23, its upper end is sealed up by the uppermost-upper-side core plate 15D, and its lower end is sealed up by the lowermost-lower-side core plate 15E. The oil vertical passage L2 is also communicated with each oil passage 21 between the core plates 15A and 15B.

In the central oil-outlet vertical passage L3, its upper end opens toward the top communication passage 19 formed by the top plate 14, and its lower end opens toward one end part which is near to the center of the opening part 41 (that is, the communication passage 43) formed in the swelling part 40 in the distance plate 13. The central oil-outlet vertical passage L3 is separated from (that is, not connected to) the oil passages 21 between the core plates 15A and 15B and oil is led only in the stacking direction therein. Furthermore, the lower end of the oil-outlet vertical passage L3 and the oil-outlet passage port 29 which is located on the corner part of the base plate 12 are communicated each other by the communication passage 43.

Furthermore, in the first embodiment, the above oil-outlet vertical passage L3 corresponds to "first vertical passage" in Claims.

Furthermore, as shown by the dashed arrows in FIG. 4, a pair of cooling water vertical passages W1 and W2 is constituted by stacking the cooling water communication holes 24 of each core plate 15. The cooling water vertical passages W1 and W2 are along the stacking direction just like the oil vertical passages L1 and L2. In the cooling-water-inlet vertical passage W1, its upper end is sealed up by the uppermost-upper-side core plate 15D, and its lower end opens toward the cooling-water-inlet passage port 31 and is linearly connected to the cooling-water-inlet passage port 31. In the cooling-water-outlet vertical passage W2, its upper end is sealed up by the uppermost-upper-side core plate 15D, and its lower end opens toward the cooling-water-outlet passage port 32 and is linearly connected to the cooling-water-outlet passage port 32. These cooling water vertical passages W1 and W2 are respectively communicated with each cooling passage 22 between the core plates 15A and 15B. Therefore, first, cooling water flowing from the cooling-water-inlet passage port 31 is flowed upward in the cooling-water-inlet vertical passage W1 and led to the cooling water passages 22 of each stage in the core 11. Next, heat exchange is performed between oil and cooling water while the water flows in the cooling passages 22. Furthermore, the cooling water after heat exchange is flowed into the cooling-water-outlet vertical passage W2 and flowed downward in the cooling-water-outlet vertical passage W2. At last, the cooling water is flowed into the cooling-water-outlet passage port 32.

Next, a current of oil is explained. As shown by the solid arrows in FIG. 3 and FIG. 4, oil flowing from the oil-inlet passage port 28 is flowed upward in the lower-side-oil-vertical passage L1A and led to the oil passages 21 of each stage located in a lower half part of the core 11. Next, heat exchange is performed between oil and cooling water in the oil passages 21 of each stage. The oil after heat exchange is flowed into the oil vertical passage L2 and flowed upward (that is, to the top side) in the oil vertical passage L2. Thereby, the oil is led to the oil passages 21 of each stage located in an upper half part of the core 11. That is to say, the oil is flowed so as to make a U-turn from the lower half part area to the upper half part area in the core 11. The oil further cooled in the oil passages 21 of each stage of the upper half part is flowed into the upper-side-oil-vertical passage L1B and flowed upward there. Thereby, the oil is led to the central oil-outlet vertical passage L3 through the top communication passage 19. Furthermore, the oil is flowed downward in the oil-outlet vertical passage L3 and flowed into the oil-outlet passage port 29 through the communication passage 43 of the distance plate 13.

Figure 6:
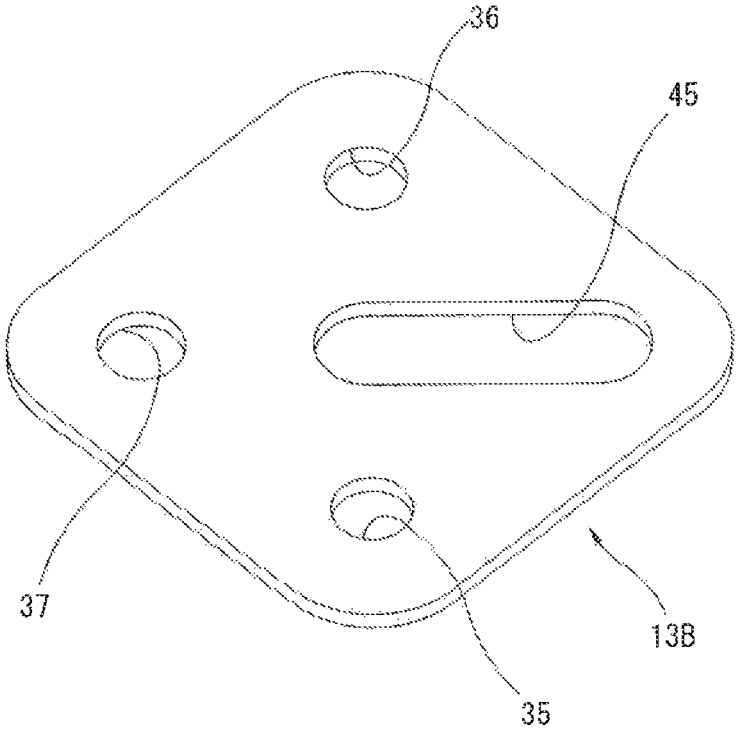
FIG. 6 is a perspective view of a distance plate of the first reference embodiment.
Figure 7:
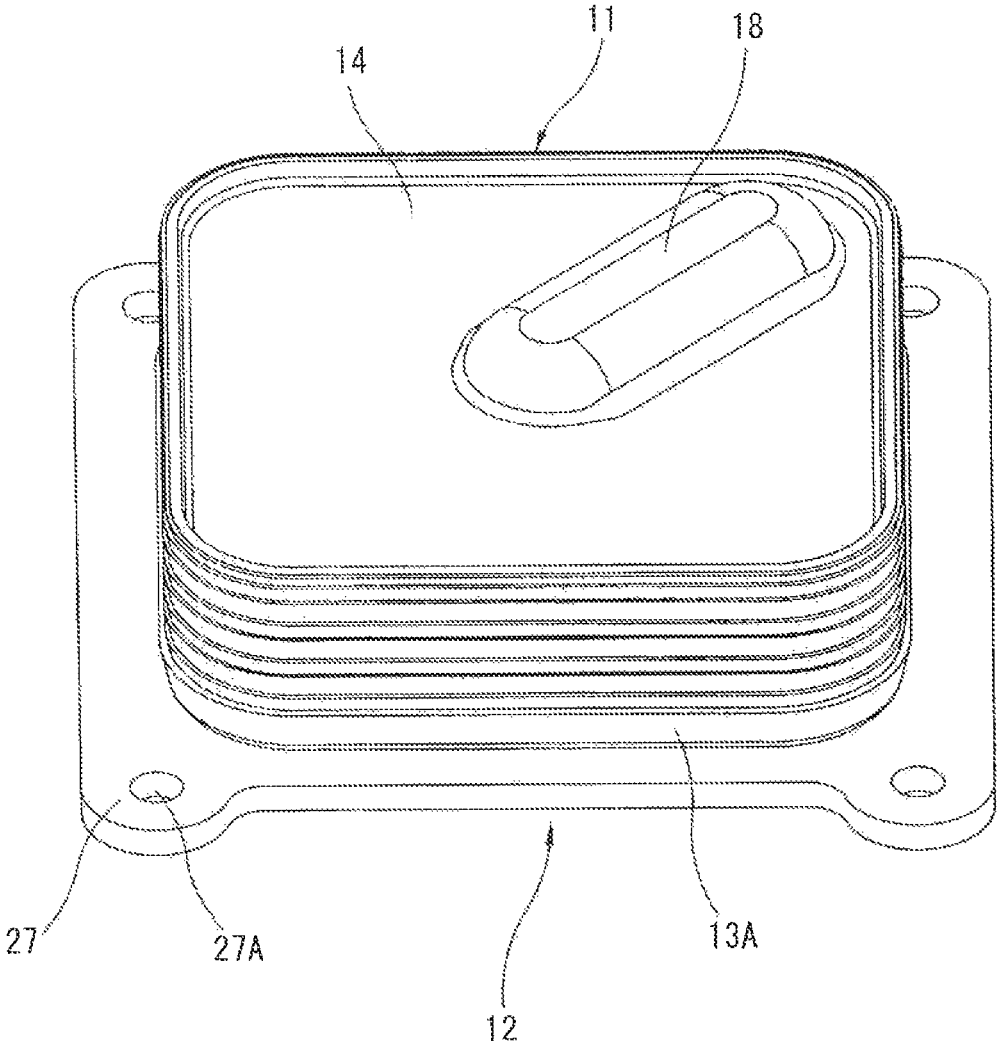
FIG. 7 is a perspective view of an oil cooler in the second embodiment of a heat exchanger according to the present embodiment.
Figure 8:
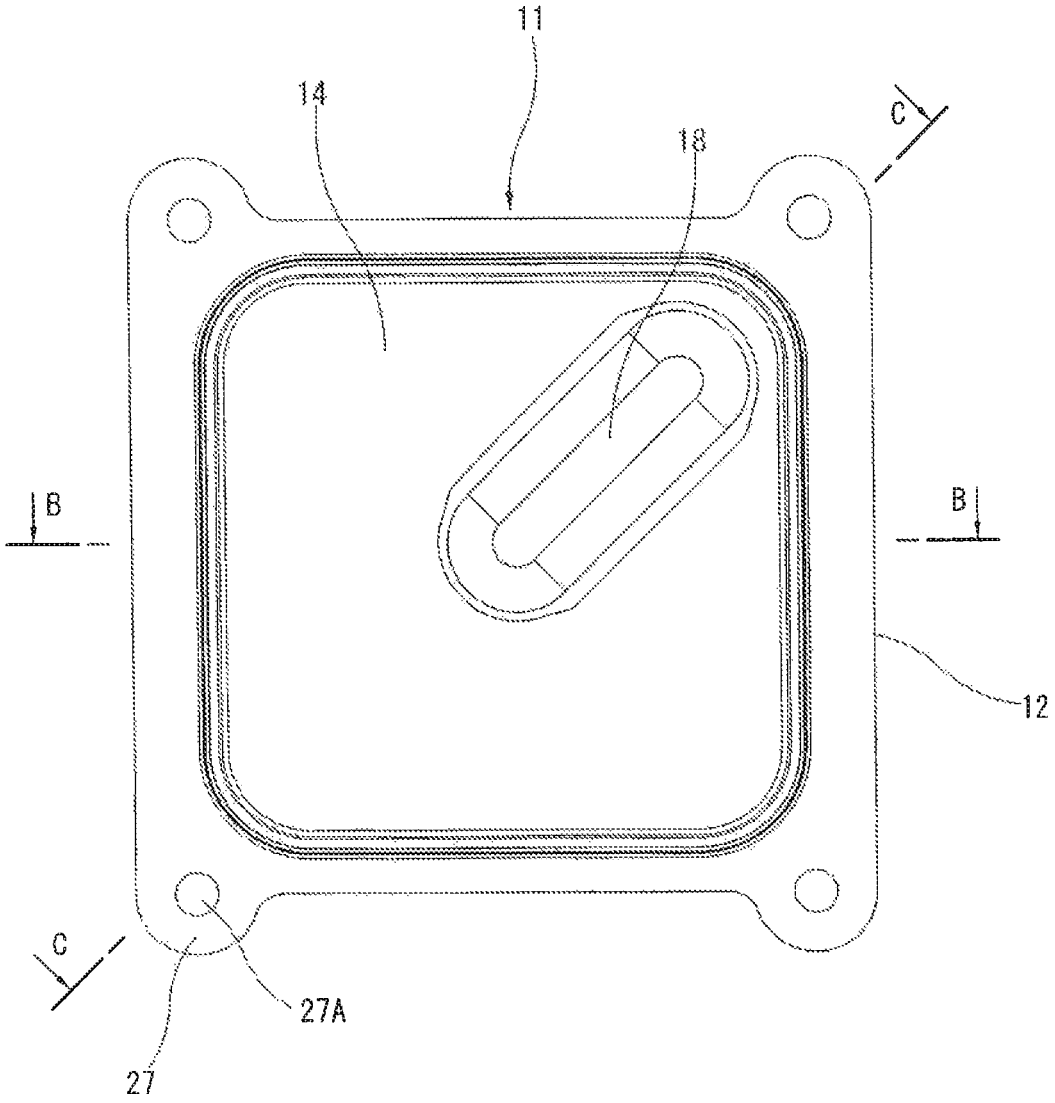
FIG. 8 is a top view of the oil cooler of the second embodiment.

FIG. 6 shows a distance plate 13B according to the first reference embodiment. This distance plate 13B has a plate shape thicker than the distance plate 13 of the first embodiment shown in FIG. 5 has. Furthermore, its entire lower surface is adhered and joined to the upper surface of the base plate 12, and its entire upper surface is adhered and joined to the lower surface of the lowermost-lower-side core plate 15E. The distance plate 13B includes a cooling-water-inlet communication hole 35, a cooling-water-outlet communication hole 36, and an oil-inlet communication hole 37, which are penetratingly formed. Furthermore, it includes a slit-like communication hole 45, which is penetratingly formed, as constitution corresponding to the communication passage 43 of the first embodiment.

While comparing the first embodiment with such a first reference embodiment, characteristic constitution and effects of the first embodiment are explained. First, in the first embodiment, it is possible to realize weight reduction because the thickness of the distance plate 13 is sufficiently reduced as compared with the distance plate of the first reference embodiment.

Furthermore, the swelling part 40 which swells from the bottom wall part 33 of the distance plate 13 in the stacking direction is arranged and the tip flange part 42 of the swelling part 40 is joined to the lower surface of the lowermost-lower-side core plate 15E which constitutes the lowermost surface of the core 11. Thereby, it is possible to form the communication passage 43 inside the swelling part 40. The communication passage 43 can communicate the oil-outlet vertical passage L3 with the oil-outlet passage port 29 of the base plate 12, although they are arranged apart from each other. That is, in the first embodiment, it is possible to make the distance plate 13 have the communication passage 43 with weight reduction of the distance plate 13, as compared with the first reference embodiment.

Furthermore, the auxiliary passage 34 in which cooling water flows is formed between the upper surface of the bottom wall part 33 of the distance plate 13 and the lower surface of the lowermost-lower-side core plate 15E, and the auxiliary passage 34 and the communication passage 43 are liquid-tightly partitioned each other by the swelling part 40. Therefore, the auxiliary passage 34 in which cooling water flows functions as a cooling water passage for heat exchange with the adjacent oil passage 21 in the bottom step of the core 11. Therefore, it is possible to increase the heat exchange amount in a limited package, as compared with case of using the distance plate 13B of the first reference embodiment.

Moreover, the distance plate 13 includes a plurality of dimples 26A which juts out upward from the upper surface of the bottom wall part 33 and whose tip is joined to the lower surface of the lowermost-lower-side core plate 15E. Thereby, it is possible to secure sufficient rigidity of the distance plate 13 in the stacking direction, in spite of thinning of the distance plate 13 as described above.

Next, the second embodiment according to the present invention is explained on the basis of FIG. 7 to FIG. 12. Hereinafter, mainly different points from the first embodiment are explained, and overlapping points are properly omitted.

In this second embodiment, considering passage layout in the internal combustion engine/automatic transmission side, a location where an oil passage port formed in the base plate 12 is arranged is different from of that of the first embodiment. Therefore, interior oil current is also different.

Figure 11:
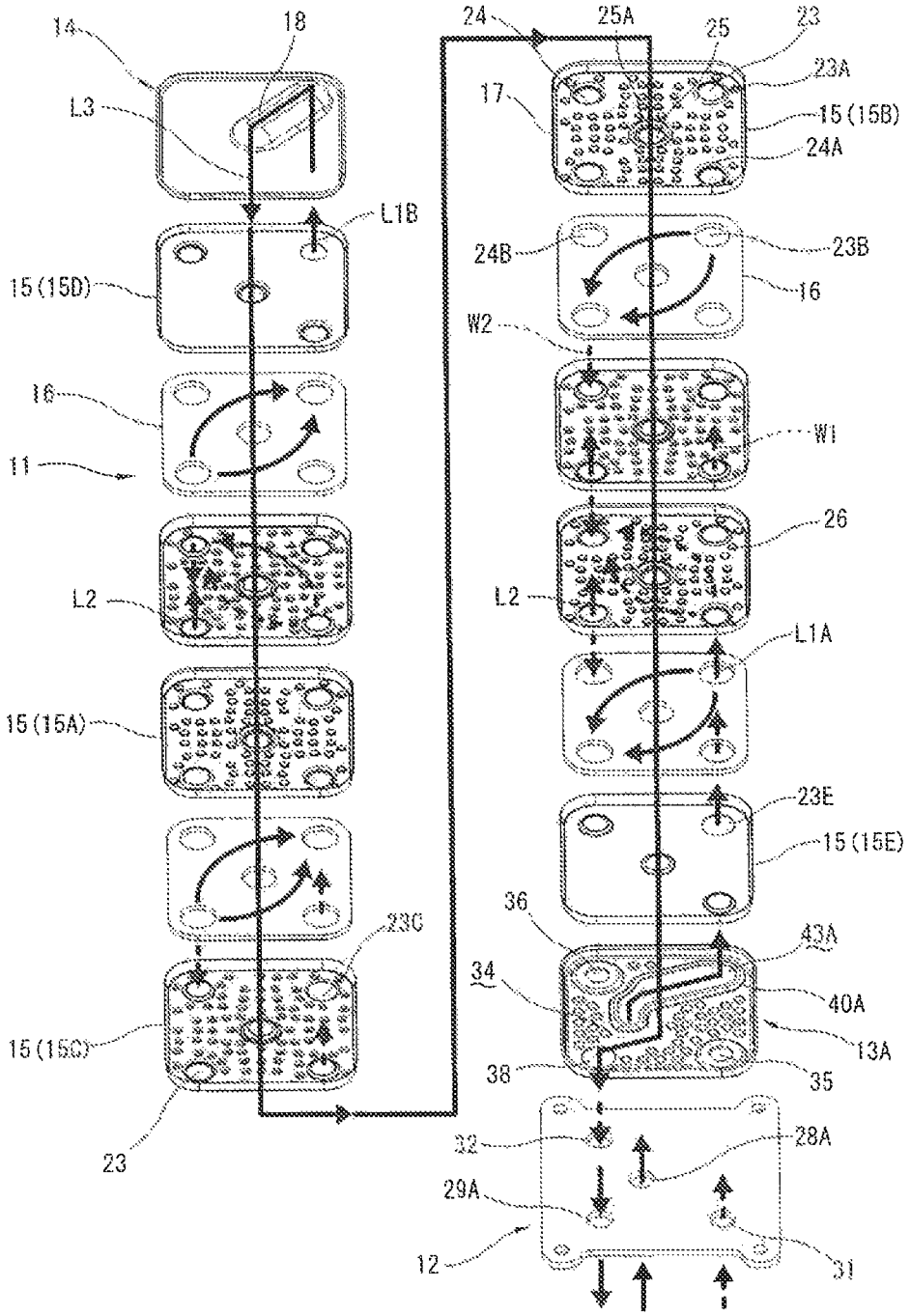
FIG. 11 is an exploded perspective view of the oil cooler of the second embodiment.

For details, as shown in FIG. 11, an oil-inlet passage port 28A is formed near the center of the base plate 12, and an oil-outlet passage port 29A is formed at one corner part on a diagonal line which is different from a diagonal line where the cooling-water-inlet passage port 31 and the cooling-outlet-passage port 32 are arranged. Furthermore, with respect to internal layout of the core 11, the sealing part 23C, the oil communication passage 23E, the lower-side-oil-vertical passage L1A, and the upper-side-oil-vertical passage L1B are arranged in the opposite side on the diagonal line, as compared with internal layout of the core 11 in the first embodiment.

Figure 12:
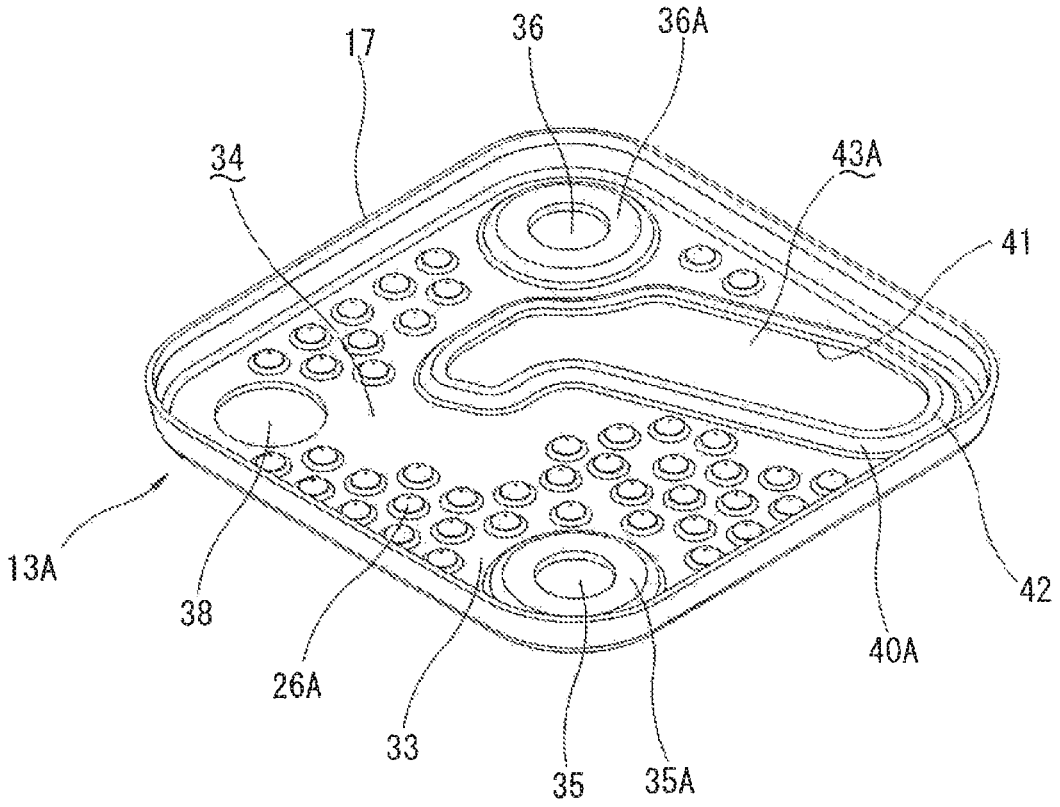
FIG. 12 is a perspective view of a distance plate of the second embodiment.

As shown in FIG. 12, the distance plate 13A is constituted so that oil is flowed in the auxiliary passage 34 formed inside the distance plate 13A. Therefore, boss parts 35A and 36A are respectively arranged around the cooling-water-inlet communication port 35 and the cooling-water-outlet communication port 36, which are arranged on one diagonal line. Furthermore, an oil-outlet communication port 38, which is formed in a corner part of the other diagonal line, is formed as a simple hole not having a boss part. The swelling part 40A formed in the distance plate 13A is bent into an approximate L-shape so as to avoid the central oil-outlet vertical passage L3, and the oil-inlet passage port 28A formed near the center of the base plate 12 and the lower-side oil vertical passage L1A formed at a corner part of the core 11 are communicated by the communication passage 43 formed inside the swelling part 40A.

A current of oil is explained. As shown by solid arrows in FIG. 10 and FIG. 11, oil flowing from the oil-inlet passage port 28A is flowed into the lower-side-oil-vertical passage L1A through the communication passage 43A formed in the distance plate 13, flowed upward in the lower-side-oil-vertical passage L1A, and led to the oil passages 21 of each stage located in a lower half part of the core 11. Heat exchange is performed between oil and cooling water in the oil passages 21 of each stage. The oil after heat exchange is flowed into the oil vertical passage L2 and flowed upward (that is, to the top side) in the oil vertical passage L2. Thereby, the oil is led to the oil passages 21 of each stage located in an upper half part of the core 11. That is to say, the oil is flowed so as to make a U-turn from the lower half part area to the upper half part area in the core 11, just like the first embodiment. The oil further cooled in the oil passages 21 of each stage of the upper half part is flowed into the upper-side-oil-vertical passage L1B and flowed upward there. Thereby, the oil is led to the central oil-outlet vertical passage L3 through the top communication passage 19. Furthermore, the oil is flowed downward in the oil-outlet vertical passage L3, and flowed into the oil-outlet passage port 29A through the auxiliary passage 34 and the oil-outlet communication port 38 of the distance plate 13A.

In the distance plate 13A, in order not to hinder an oil current flowing from the oil-outlet vertical passage L3 to the oil-outlet communication port 38 the dimples 26A aren't formed near a range connecting a lower end of the oil-outlet vertical passage L3 with the oil-outlet communication port 38. That is, the range becomes a mere flat upper surface of the bottom wall 33.

Furthermore, in the second embodiment, the lower-side-oil-vertical passage L1A corresponds to "first vertical passage" in Claims, and the oil-outlet vertical passage L3 corresponds to "second vertical passage" in Claims.

Figure 13:
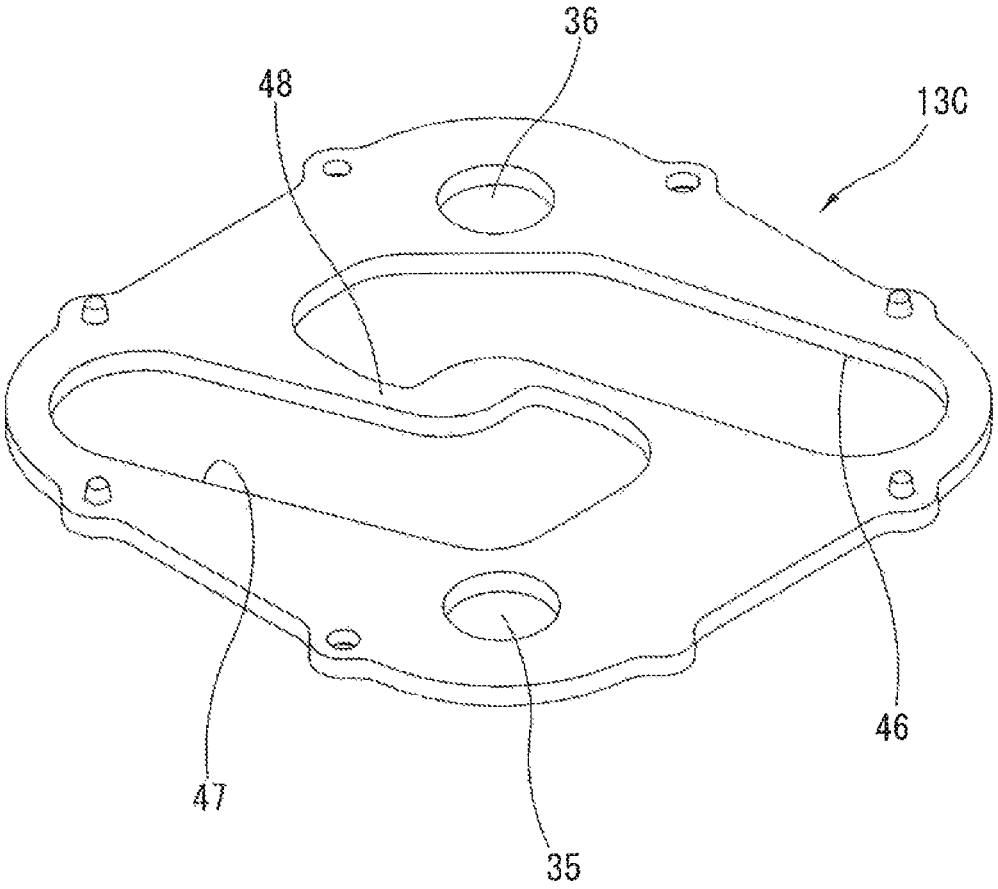
FIG. 13 is a perspective view of a distance plate of the second reference embodiment.

FIG. 13 shows a distance plate 13C according to the second reference embodiment. This distance plate 13C has a plate shape thicker than the distance plate 13A of the second embodiment shown in FIG. 12 has. Furthermore, its entire lower surface is adhered and joined to the upper surface of the base plate 12, and its entire upper surface is adhered and joined to the lower surface of the lowermost-lower-side core plate 15E. The distance plate 13C includes a cooling-water-inlet communication hole 35, a cooling-water-outlet communication hole 36, and an oil-inlet communication hole 37, which are penetratingly formed. Furthermore, it includes a slit-like communication hole 46, which is penetratingly formed, as constitution corresponding to the communication passage 43A of the second embodiment and another slit-like communication hole 47, which is penetratingly formed, as constitution corresponding to the auxiliary passage 34 of the second embodiment.

While comparing the second embodiment with such a second reference embodiment, characteristic constitution and effects of the second embodiment are explained. First, in the second embodiment, it is possible to realize weight reduction just like the first embodiment because the thickness of the distance plate 13A is reduced as compared with the distance plate of the second reference embodiment. Furthermore, the swelling part 40A is formed on the distance plate 13A. Thereby, it is possible to form the communication passage 43A inside the swelling part 40A. The communication passage 43 can communicate the oil-inlet passage port 28A of the base plate 12 with the lower-side-oil-vertical passage L1A of the core 11, although they are arranged apart from each other.

Moreover, the distance plate 13A includes a plurality of dimples 26A which juts out upward from the upper surface of the bottom wall part 33 and whose tip is joined to the lower surface of the lowermost-lower-side core plate 15E. Thereby, it is possible to secure sufficient rigidity of the distance plate 13A in the stacking direction.

In the second reference embodiment shown in FIG. 13, two slit-like communication holes 46 and 47 are formed close each other. Therefore, in order to secure rigidity of a bridge part 48 between the communication holes 46 and 47, it is necessary to limit each size of the communication holes 46 and 47 and to secure certain plate thickness of the distance plate. In contrast, in the second embodiment, the auxiliary passage 34 in which oil flows is formed between the upper surface of the bottom wall part 33 of the distance plate 13A and the lower surface of the lowermost-lower-side core plate 15E, and the auxiliary passage 34 and the communication passage 43A are liquid-tightly partitioned each other by the swelling part 40A. Furthermore, this auxiliary passage 34 (and the oil-outlet communication port 38) functions a communication passage which communicates the oil-outlet vertical passage L3 formed near to the center of the core 11 with the oft-outlet passage port 29A formed at a corner part of the base plate 12 in addition to the above communication passage 43A. Therefore, it is no necessary to form such a bridge part of the second reference embodiment, and each size of the communication passage 43A and the auxiliary passage 34 isn't limited, so it is possible to restrain passage resistance by sufficiently securing passage section area. Furthermore, the plate thickness of the distance plate isn't limited unlike in the second embodiment, so it is possible to attain miniaturization by reduction of length in the stacking direction.

Figure 9:
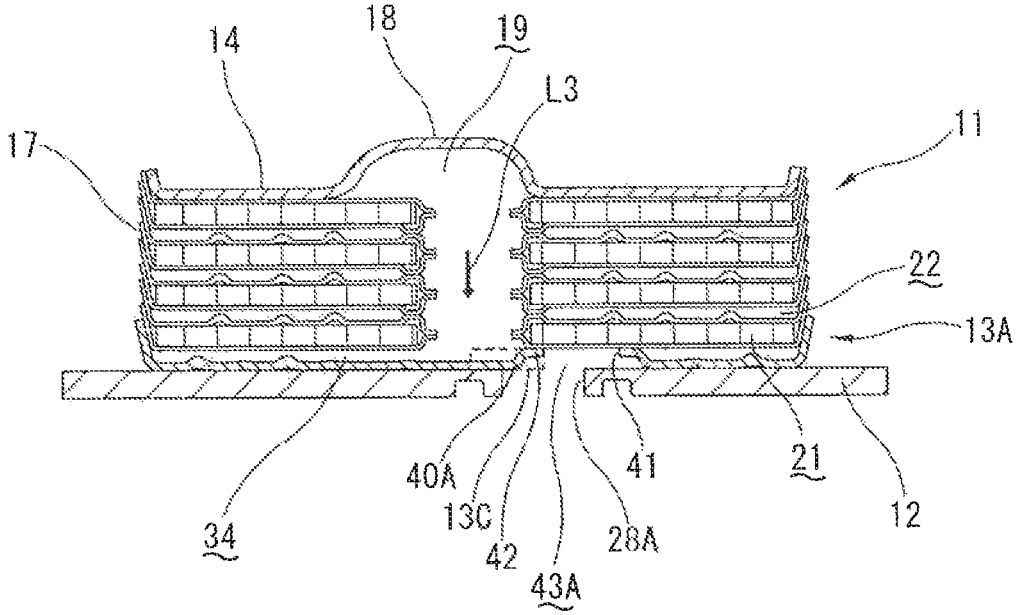
FIG. 9 is a cross-sectional view taken along a plane indicated by the B-B in FIG. 8.
Figure 10:
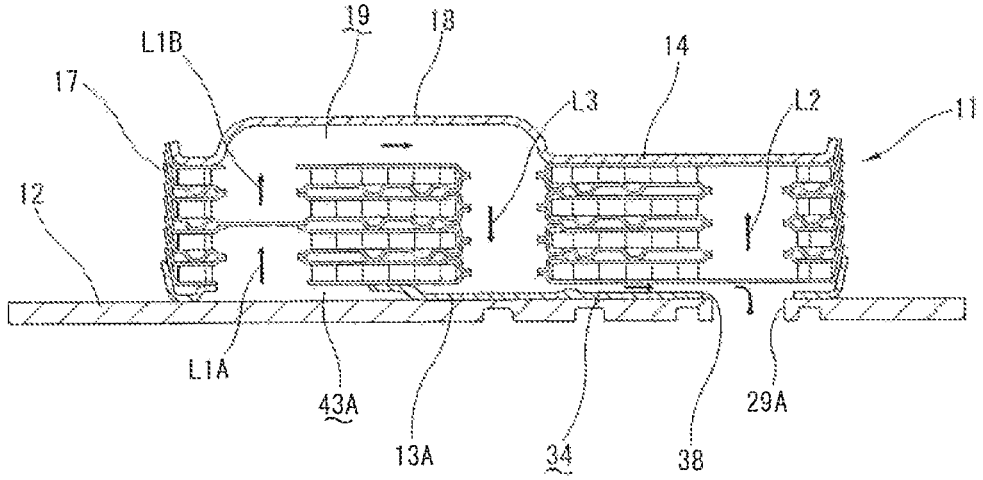
FIG. 10 is a cross-sectional view taken along a plane indicated by the line C-C in FIG. 8.

As shown in FIG. 9, the oil-inlet passage port 28A formed near to the center of the base plate 12 and the oil-outlet vertical passage L3 extending in the stacking direction near the center of the core 11 partially overlap each other in the stacking direction. Furthermore, the swelling part 40A near the overlapping part stands up from the bottom wall part 33 near the oil-inlet passage port 23A, and its tip flange part 42 is joined to the lower surface of the lowermost-lower-side core plate 15E located around the oil-outlet vertical passage L3.

A dashed line in FIG. 9 represents a sectional shape in case of using the thick plate-like shaped distance plate 13C of the second reference embodiment shown in FIG. 13. In this case, the distance plate 13C partially seals up the oil-inlet passage port 28A and the oil-outlet vertical passage L3. Thereby, as its opening area is reduced, passage resistance is increased.

In contrast, in the second embodiment, the swelling part 40A is formed so that a peripheral part of the oil-inlet passage port 28A of the base plate 12 and a peripheral part of the oil-outlet vertical passage L3 of the core 11 are slantingly connected each other. Thereby, the oil-inlet passage port 28A and the oil-outlet vertical passage L3 aren't partially sealed up. Therefore, it is possible to largely secure the opening areas of the oil-inlet passage port 28A and the oil-outlet vertical passage L3. Thereby, it is possible to restrain increase of passage resistance.

Figure 14:
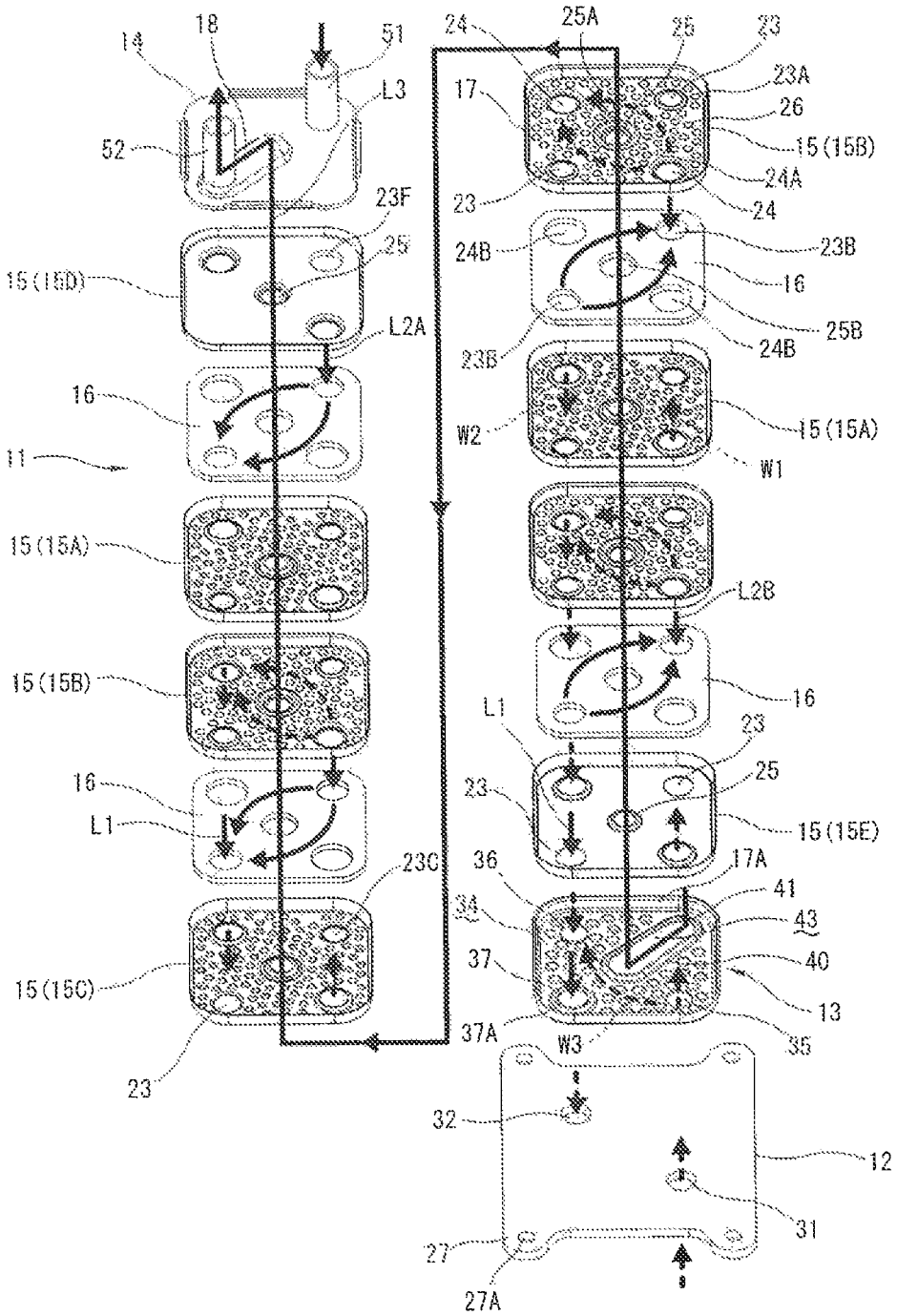
FIG. 14 is an exploded perspective view of an oil cooler in the third embodiment of the present invention.

FIG. 14 shows the third embodiment according to the present invention. In this third embodiment, an oil current is different from that in the first embodiment, and an oil passage port is not formed in the base plate 12 but the top plate 14.

Specifically, in the third embodiment, the base plate 12 has no oil passage port which is an inlet or outlet port of oil. In contrast, the top plate 14 includes a pair of oil passage ports (not shown) in each end parts on a diagonal line along the top swelling part 18, and includes an oil-inlet pipe 51 and an oil-outlet pipe 52, which are an inlet and outlet ports of oil, respectively standing up there. The oil-inlet pipe 51 is joined by brazing around the oil passage port (not shown) formed in a corner part of the top plate 14. The oil-outlet pipe 52 is joined by brazing around the oil passage port (not shown) formed in an upper side of an end part closer to the outer periphery of the top swelling part 18.

In the uppermost-upper-side core plate 15D, an oil communication hole 23F, which is connected to the oil-inlet pipe 51, is formed at a place corresponding to the oil-inlet pipe 51. In contrast, no oil communication hole is formed at a place corresponding to the oil-outlet pipe 52 (or a sealing part is formed there.).

In the intermediate-stage-lower-side core plate 15C, the sealing part 23C which seals up the oil communication hole is formed at a place corresponding to the oil-inlet pipe 51 and the oil communication hole 23 is formed at a place corresponding to the oil-outlet pipe 52. Furthermore, the oil vertical passage L2 along the stacking direction is partitioned into an upper-side-oil-vertical passage L2A and a lower-side-oil-vertical passage L2B by the sealing part 23C.

In the lowermost-lower-side core plate 15E, a pair of the oil communication holes 23 is formed at two portions on a diagonal line along the top swelling part 18.

Furthermore, the communication passage 43, which is formed inside the swelling part 40 of the distance plate 13, communicates the oil vertical passage L2 (lower-side-oil-vertical passage L2B) formed in a corner part corresponding to the oil-inlet pipe 51 with the central oil-outlet vertical passage L3. Moreover, the communication passage 34, which is formed between the upper surface of the bottom wall part 33 of the distance plate 13 and the lower surface of the lowermost-lower-side core plate 15E, is constituted so that cooling water flows therein just like the first embodiment.

A current of oil is explained. As shown by solid arrows in FIG. 14, oil flowing from the oil-inlet pipe 51 is flowed into the upper-side-oil-vertical passage L2A, flowed downward in the upper-side-oil-vertical passage L2A, and led to the oil passages 21 of each stage located in an upper half part of the core 11. Heat exchange is performed between oil and cooling water in the oil passages 21 of each stage. The oil after heat exchange is flowed into the oil vertical passage L1 and flowed downward in the oil vertical passage L1. Thereby, the oil is led to the oil passages 21 of each stage located in a lower half part of the core 11. That is to say, the oil is flowed so as to make a U-turn from the upper half part area to the lower half part area in the core 11. The oil further cooled in the oil passages 21 of each stage of the lower half part is flowed into the lower-side-oil-vertical passage L2B and flowed downward there. Thereby, the oil is led to the central oil-outlet vertical passage L3 through the communication passage 43 formed in the distance plate 13. Furthermore, the oil is flowed upward in the oil-outlet vertical passage L3, and flowed into the oil-outlet pipe 52 through the top communication passage 19 (see FIG. 3) formed inside the top swelling part 18 of the top plate 14.

Thus, in the third embodiment in which the oil passage ports (the oil-inlet pipe 51 and the oil-outlet pipe 52) which are outlet and inlet of oil are formed in the top plate 14 side, it is possible to provide a similar effect to the above first embodiment. That is, it is possible to form the communication passage 43 inside the swelling part 40 which swells up and is formed in the distance plate 13 with weight reduction of the distance plate 13. The communication passage 43 communicates the lower-side-oil-vertical passage L2B with the oil-outlet vertical passage L3 although they are arranged apart from each other. Furthermore, as the auxiliary passage 34 functions as a cooling water passage just like the first embodiment, it is possible to improve heat exchanging efficiency without increasing size of the device.

Furthermore, it is also possible to use such a structure that the inlet and outlet of oil are formed in the top plate 14 side in the second embodiment.

Although several embodiments according the present invention are explained above, this invention is not limited to the above embodiments and can be changed as a necessary. For example, in each constitution of the first to third embodiments, it is possible to reverse the oil-inlet passage port 28 (28A) and the oil-outlet passage port 29 (29A) and to constitute them so that oil is flowed in a direction opposite to a direction of arrows shown in the figures. Furthermore, it is possible to reverse oil and cooling water. Even in this case, fins 16 are interposed in the oil passages.

Furthermore, in each of illustrated embodiments, it is a structure that the oil passages 21 and the cooling water passages 22 are alternately formed by stacking the core plates 15 without having a housing, that is, a housing-less structure. However, it is possible to use a structure that a core part including only oil passages is housed in a housing where cooling water flows.

In the above embodiments, it is a structure where the cooling water passage ports, which are inlet and outlet of cooling water, are formed in the base plate 12. However, it may be a structure where the cooling water passage ports are formed in the top plate 14 side.

Moreover, in the above embodiments, oil and cooling water are used as a first medium and a second medium. However, some other mediums may be used. For example, in an air-cooled oil cooler, air is used instead of cooling water.

Furthermore, at least the opening part 41 of the swelling part 40 (40A) may be formed in a position linking to a vertical passage L1 (L3). For example, in the other part, the flange part 42 may be formed so as to be extended inside and so as to seal a part of the opening part in order to secure rigidity.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A heat exchanger comprising:

a core including:

a plurality of core plates which are stacked;

first passages in which a first medium flows;

second passages in which a second medium flows, the first passages and the second passages being alternately formed between adjacent core plates in a stacking direction; and a plurality of first vertical passages in which the first medium or the second medium flows, the first vertical passages being formed along the stacking direction;

a base plate; and a distance plate interposed between the base plate and the core;

wherein each of the first vertical passages is arranged apart from each other in a direction orthogonal to the stacking direction and communicated with each other by a communication passage;

wherein the distance plate includes a bottom wall part and a swelling part, the bottom wall part being joined to an upper surface of the base plate, the swelling part swelling up in the stacking direction from the bottom wall part so as to surround a circumference of the communication passage which communicates each of the first vertical passages with each other and being joined to a lowermost surface of the core in a flange part of a tip of the swelling part;

wherein a first one of the first vertical passages is located at one of a central part or a corner part of the core plates; and wherein a second one of the first vertical passages is located at another one of the central part or the corner part of the core plates.

2. The heat exchanger as claimed in claim 1, wherein the distance plate is rectangular and shallow, and corresponds in shape to the core plates.

3. The heat exchanger as claimed in claim 1, wherein:

an auxiliary passage in which the first medium or the second medium flows is formed between an upper surface of the bottom wall part of the distance plate and a lowermost surface of a core plate of the plurality of core plates; and the auxiliary passage and the communication passage are partitioned by the swelling part.

4. The heat exchanger as claimed in claim 1, wherein:

the distance plate includes a plurality of dimples on the upper surface of the bottom wall part of the distance plate; and tips of the dimples touch the lowermost surface of a core plate of the plurality of core plates.

5. A heat exchanger comprising:

a core including:

a plurality of core plates which are stacked;

first passages in which a first medium flows;

second passages in which a second medium flows, the first passages and the second passages being alternately formed between adjacent core plates in a stacking direction; and a plurality of first vertical passages in which the first medium or the second medium flows, the first vertical passages being formed along the stacking direction;

a base plate; and a distance plate interposed between the base plate and the core;

wherein each of the first vertical passages is arranged apart from each other in a direction orthogonal to the stacking direction and communicated with each other by a communication passage;

wherein the distance plate includes a bottom wall part and a swelling part, the bottom wall part being joined to an upper surface of the base plate, the swelling part swelling up in the stacking direction from the bottom wall part so as to surround a circumference of the communication passage which communicates each of the first vertical passages with each other and being joined to a lowermost surface of the core in a flange part of a tip of the swelling part, and wherein a first one of the first vertical passages is located at one of a central part or a corner part of the core plates;

a second one of the first vertical passages is located at another one of the central part or the corner part of the core plates;

the distance plate corresponds in shape to the core plates;

an auxiliary passage in which the first medium or the second medium flows is formed between an upper surface of the bottom wall part of the distance plate and a lowermost surface of a core plate of the plurality of core plates;

the auxiliary passage and the communication passage are partitioned by the swelling part;

the distance plate includes at least one dimple on the upper surface of the bottom wall part of the distance plate; and a tip of at least one dimple touches the lowermost surface of the core plate of the plurality of core plates.

* * * * *